US007729654B2

(12) United States Patent
Awaya

(10) Patent No.: US 7,729,654 B2
(45) Date of Patent: Jun. 1, 2010

(54) CLEANING APPARATUS AND IMAGE FORMING APPARATUS

(75) Inventor: Tetsuro Awaya, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 248 days.

(21) Appl. No.: 11/937,158

(22) Filed: Nov. 8, 2007

(65) Prior Publication Data

US 2008/0260439 A1 Oct. 23, 2008

(30) Foreign Application Priority Data

Nov. 15, 2006 (JP) ..... 2006-308894

(51) Int. Cl.
*G03G 21/00* (2006.01)

(52) U.S. Cl. ..... 399/349; 399/350; 399/353

(58) Field of Classification Search ..... 399/349, 399/350, 351, 353
See application file for complete search history.

(56) References Cited

U.S. PATENT DOCUMENTS 4,426,151 A * 1/1984 Aguro et al. ..... 399/349
2003/0086738 A1* 5/2003 Sakanobe et al. ..... 399/350

FOREIGN PATENT DOCUMENTS

| | | | |
|---|---|---|---|
| JP | 11-161125 | A | 6/1999 |
| JP | 2004-177799 | A | 6/2004 |
| JP | 2004-271968 | A | 9/2004 |
| JP | 2005-258044 | A | 9/2005 |

OTHER PUBLICATIONS

Chinese Office Action dated Jun. 5, 2009 in Chinese Application No. 200710186931.5, and an English-language translation therefor.

* cited by examiner

*Primary Examiner*—David M Gray
*Assistant Examiner*—Ruth N Labombard
(74) *Attorney, Agent, or Firm*—Fitzpatrick, Cella, Harper & Scinto

(57) ABSTRACT

A cleaning device includes a cleaning blade for contacting to a rotatable image bearing member and removing toner from the image bearing member; an auxiliary cleaning member, disposed upstream of the cleaning blade with respect to a rotational direction of the image bearing member, for assisting cleaning operation of the cleaning blade; and a sheet contacted to the auxiliary cleaning member and to a surface of the cleaning blade which is remote from the image bearing member.

6 Claims, 4 Drawing Sheets

CLEANING APPARATUS AND IMAGE FORMING APPARATUS

FIELD OF THE INVENTION AND RELATED ART

The present invention relates to a cleaning apparatus for an image forming apparatus, such as a copying machine or a printer, which is of the transfer type. More specifically, it relates to a cleaning apparatus for removing the developer remaining on the image bearing member, such as an electrophotographic photosensitive member, of an image forming apparatus after the transfer of a developer image formed on the image bearing member. It also relates to an image forming apparatus employing the cleaning apparatus.

The inventors of the present invention had proposed a cleaning apparatus, the cleaning performance of which remains at a satisfactory level for a long time. This cleaning apparatus is disclosed in Japanese Laid-open Patent Application 2004-271968.

This cleaning apparatus has a cleaning blade, which is in contact with the image bearing member to remove the developer (which hereafter may be referred to as residual toner) remaining on the image bearing member. It also has an auxiliary cleaning member, which is in contact with the image bearing member, and is rotates to remove the residual toner on the abovementioned image bearing member. In terms of the rotational direction of the image bearing member, the auxiliary cleaning member is on the upstream side of the cleaning blade. The auxiliary cleaning member scrapes and stirs the transfer residual toner, and also, ensures that the image bearing member is always coated with a preset (appropriate) amount of toner. In terms of the rotational direction of the image bearing member, the cleaning blade and auxiliary cleaning member are positioned so that the area of contact between the cleaning blade and image bearing member, and the area of contact between the auxiliary cleaning member and image bearing member, fall within 90° from the lowest point of the peripheral surface of the image bearing member, that is, the lower of the intersections of the direction of gravity and the peripheral surface of the image bearing member. Further, they are positioned so that the area of contact between the cleaning member and image bearing member does not overlap with the sweeping range of the auxiliary cleaning member, in terms of the direction of gravity.

In the case of this cleaning apparatus, as the transfer residual toner is removed from the image bearing member by the auxiliary cleaning member, the removed toner falls in the direction of gravity due to its own weight, and accumulates below the image bearing member, without resettling on the image bearing member. Further, as the transfer residual toner is removed from the image bearing member by the cleaning blade, the removed toner falls in the direction of gravity due to its own weight, and accumulates below the image bearing member, without resettling on the image bearing member. Thus, the amount by which toner is re-coated on the image bearing member by the auxiliary cleaning member remain stable. The re-coated toner, which is stable in amount, serves as lubricant, contributing to the reduction in the buckling of the cleaning blade, occurrences of low frequency vibrations (noises), etc. Therefore, this cleaning apparatus remains satisfactory in cleaning performance for a long time.

The cleaning blade is likely to buckle, or vibrate at a low frequency, immediately after an image forming apparatus is set up for an image forming operation, or the cartridge (inclusive of cleaning apparatus) in the image forming apparatus is replaced with a fresh one. Therefore, in order to minimize the buckling of the cleaning blade, or the occurrence of low frequency vibrations, a preset (appropriate) amount of toner is placed as lubricant along the cleaning edge of the cleaning blade, before the shipment of an image forming apparatus or a cartridge from a factory.

It is possible, however, that during the shipment, the abovementioned preset amount of toner will fall (will be lost) due to the vibrations or the like which occur during the distribution of the apparatus or cartridge. Therefore, in spite of the placement of the preset (appropriate) amount of toner along the cleaning edge of the cleaning blade, it is still possible that the cleaning blade will buckle or vibrate at a low frequency (make low frequency noises), immediately after an image forming apparatus is set up for an image forming operation, or the cartridge in the image forming apparatus is replaced with a fresh one.

As one of the means for preventing the above-described problem, it is possible to form a closed space by the peripheral surface of the drum, the cleaning blade, and a roller-shaped brush, and retain a certain amount of toner in this closed space. This solution, however, suffers from the following problem: If the amount of the toner retained in the auxiliary cleaning member is small, the toner in the closed space adheres to the auxiliary cleaning member and/or is scraped away by the auxiliary cleaning member as the auxiliary cleaning member is rotated. Therefore, the amount by which toner remains in the closed space is unstable, making it possible that the cleaning blade will buckles and/or erratically vibrate or make low frequency noises, which is one of the causes of the formation of an unsatisfactory image.

Japanese Laid-open Patent Application H11-161125 discloses another solution to the abovementioned problem. According to this application, the back side of the cleaning blade is provided with a piece of plate so that toner is retained along the cleaning edge of the cleaning blade. In the case of this structural arrangement, however, the amount by which toner is retained along the cleaning edge of the cleaning blade is affected by the amount of the transfer residual toner, and therefore, the amount by which toner remains along the cleaning edge is unstable.

Japanese Laid-open Patent Application 2005-258044 discloses another solution to the above-described problem. According to this application, unlike the preceding solutions, the cleaning apparatus is provided with a sleeve on which a magnetic brush is formed. In terms of the rotational direction of the image bearing member, the sleeve is on the upstream side of the cleaning blade. Further, the cleaning apparatus is provided with a member for accumulating toner on the back side of the cleaning blade. This member is positioned to make no contact with the sleeve.

This structural arrangement is also problematic in that, as copies which are low in image ratio are continuously produced by a substantial number, not only does the amount by which toner reaches the cleaning blade reduce, but also, the toner having accumulated along the cleaning edge adheres to the magnetic brush, making unstable the amount by which toner remains along the cleaning edge of the cleaning blade.

SUMMARY OF THE INVENTION

The primary object of the present invention is to stabilize the amount by which toner remains along the cleaning edge of the cleaning blade.

According to an aspect of the present invention, there is provided a cleaning device comprising a cleaning blade for contacting to a rotatable image bearing member and removing toner from the image bearing member; an auxiliary cleaning member, disposed upstream of said cleaning blade with respect to a rotational direction of said image bearing member, for assisting cleaning operation of said cleaning blade; and a sheet contacted to said auxiliary cleaning member and to a surface of said cleaning blade which is remote from said image bearing member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the image forming apparatus in accordance with the present invention will be described with reference to the appended drawings.

Embodiment (1) General Structure of Image Forming Apparatus

Figure 1:
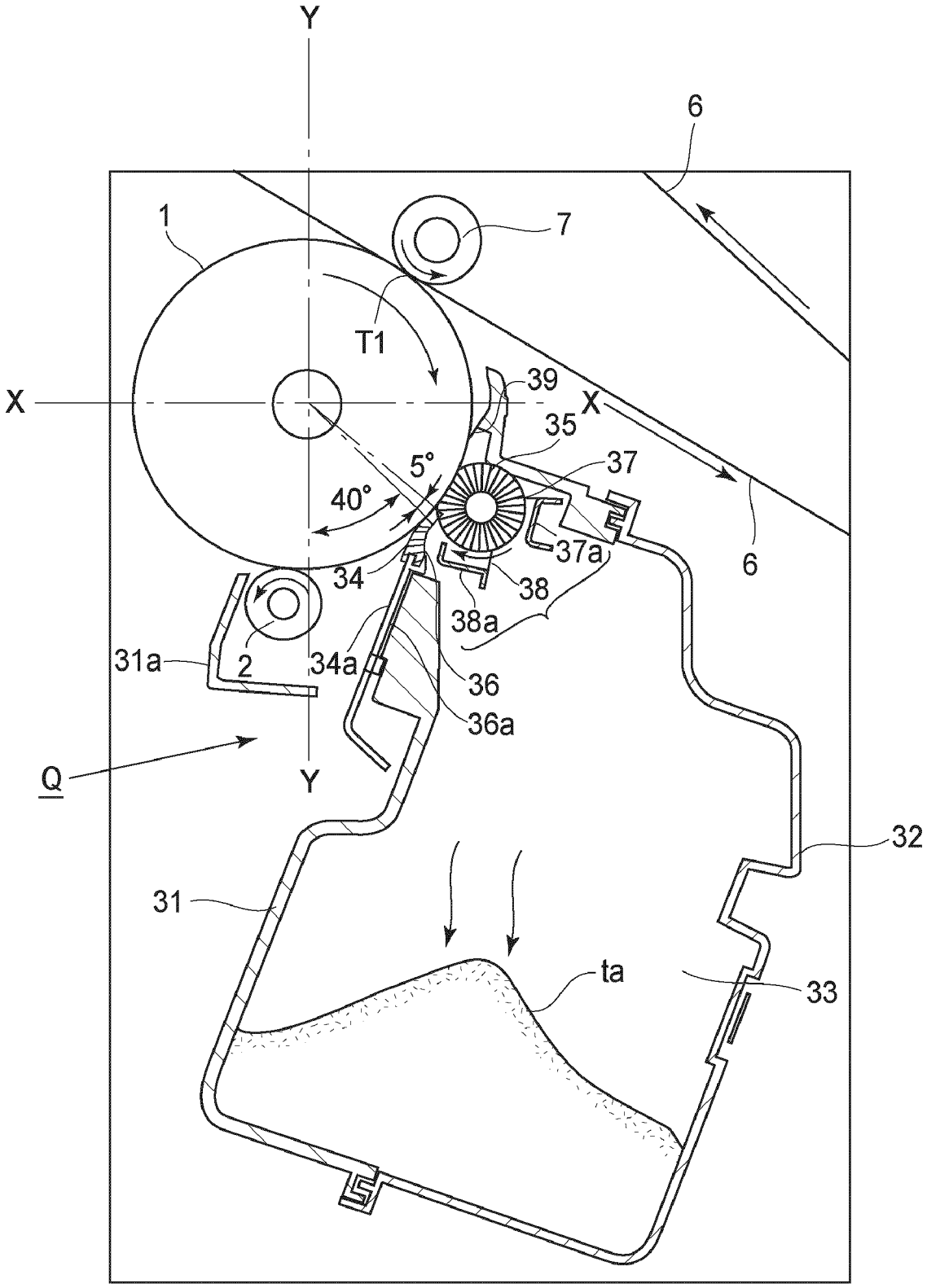
FIG. 1 is a sectional view of the drum cartridge portion of the image forming apparatus in one of the preferred embodiments of the present invention.
Figure 5:
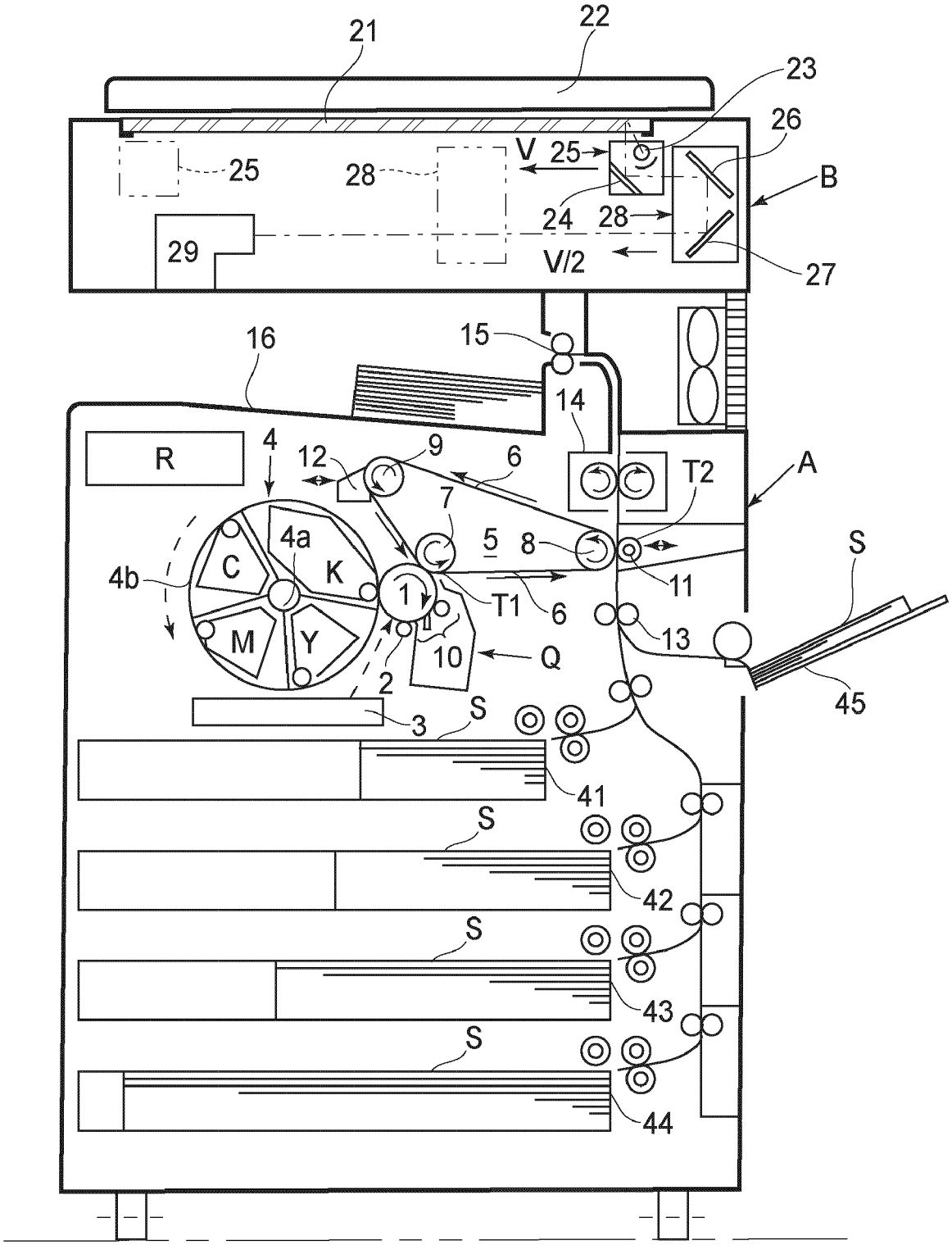
FIG. 5 is a sectional view of the image forming apparatus in the abovementioned preferred embodiment of the present invention, showing the general structure of the apparatus.

FIG. 5 is a schematic sectional view of the image forming apparatus in this embodiment, showing the general structure of the apparatus. FIG. 1 is an enlarged view of the drum cartridge portion of the image forming apparatus shown in FIG. 5. The image forming apparatus in this embodiment is an electrophotographic copying machine of the so-called single drum type, that is, an image forming apparatus which employs a single photosensitive member, and synthetically forms a full-color image on the photosensitive member by repeating an image forming operation for forming a monochromatic image, four times per full-color image.

This copying machine has an image forming portion A and an image reading portion B (digital color image reading portion). The image forming portion A is provided with an image forming portion proper and a paper feeding mechanism portion. The image reading portion B is above the image forming portion A.

An original, for example, a color original (full-color image), is placed on an original placement platen 21 of the image reading portion B, with the image bearing surface of the original facing downward, so that the original aligns with a preset referential line, or the like. Then, the original is covered with an original pressing plate 22. The original placement platen 21 is formed of transparent glass.

There is a first scanning unit 25 under the original placement platen 21. The first scanning unit 25 has an original illuminating lamp 23 and a first mirror 24. As a copy start button is pressed, the first scanning unit 25 is driven so that it moves along the bottom surface of the original placement platen 21 at a preset velocity V. Further, a second scanning unit 28 having second and third mirrors 26 and 27 is driven so that it also moves along the bottom surface of the original placement platen 21 at a velocity of V/2, that is, half the velocity at which the first scanning unit 25 is moved. As the first and second scanning units 25 and 28 are driven as described above, the bottom surface of the color original on the original placement platen 21 is scanned so that the pictorial information of the original is obtained by a full-color sensor unit 29; the beam of light projected from the original illuminating lamp 23 and reflected by the original is separated into beams of light of primary colors, and each of the beams of light of primary colors is photoelectrically read (converted into electrical signals). Then, the thus obtained electric signals are processed by an image processing portion, and are inputted into a control unit R of the image forming portion A.

The image forming portion A is equipped with an image bearing member, which is an electrophotographic photosensitive member 1 in the form of a drum with an external diameter of 60 mm (hereafter, electrophotographic photosensitive drum will be referred to simply as drum). The drum 1 is rotationally driven at a preset peripheral velocity in the clockwise direction, that is, the direction indicated by an arrow mark in the drawing. As the drum 1 is rotationally driven, the peripheral surface of the drum 1 is uniformly charged to preset polarity and potential level by a primary charge roller 2, as a charging means, which is 10 mm in external diameter. Then, the charged portion of the peripheral surface of the drum 1 is exposed by a laser unit 3 (laser scanner), as an exposing unit; it is scanned by the beam of laser light projected by the laser unit 3 while being modulated according to the picture information. As a result, an electrostatic latent image (pattern of exposure) is formed on the peripheral surface of the drum 1. More specifically, the laser unit 3 outputs a beam of laser light while modulating it with the picture signals sent from the control unit R. As the uniformly charged portion of the peripheral surface of the drum 1 is scanned (exposed) by this beam of light, an electrostatic latent image (pattern of exposure) is effected on the peripheral surface of the drum 1. The electrostatic latent image is developed by the developer (which hereafter may be referred to as toner) in the black developing device K, yellow developing device Y, magenta developing device M, or cyan developing device C of a developer unit 4 of the rotary type.

The abovementioned four developing devices K, Y, M, and C are mounted in a rotary 4*b* (rotational member), which is rotatably supported by a shaft 4*a*, making it possible to move any of the four developing devices into the development position, that is, the position in which it can develop the electrostatic latent image on the drum 1, by rotating the rotary 4*b* in a controlled manner. The electrostatic latent image on the drum surface is developed by the toner in the developing device having moved into the development position. The abovementioned charging means 2, exposing means 3, and developing means 4 make up the image forming means for forming a toner image on the drum 1.

After the formation of a toner image on the drum 1, the toner image is transferred (primary transfer) onto an intermediary transfer belt 6 (which hereafter will be referred to as belt) in a primary transfer station T1. The belt 6 is a member of an intermediary transfer unit 5, onto which a toner image is temporarily transferred. It is a flexible and endless belt, and is formed of a dielectric material. It is supported by a primary transfer roller 7, an auxiliary second transfer roller 8, and a tension roller 9, being thereby stretched around them. The primary transfer roller 7 is kept pressed against the drum 1 with the presence of the belt 6 between the roller 7 and drum 1. The interface between the drum 1 and belt 6 is the primary transfer station T1. As the auxiliary secondary transfer roller 8 is rotationally driven, the belt 6 is circularly driven by the roller 8 at a peripheral velocity, which matches the peripheral velocity of the drum 1, in the counterclockwise direction, that is, the direction indicated by an arrow mark. As a preset primary transfer bias is applied to the primary transfer roller 7, the toner image on the drum 1 is electrostatically transferred onto the belt 6 in a manner of being peeled away from the peripheral surface of the drum 1.

After the transfer of the toner image onto the surface of the belt 6, the drum surface is cleaned by a cleaning apparatus 10 (transfer residual toner on the peripheral surface of the drum 1 is removed by the cleaning apparatus 10) so that the peripheral surface of the drum 1 is repeatedly used for an image forming operation. The cleaning apparatus 10 will be described in detail in Section 2.

In the case of the image forming apparatus in this embodiment, the abovementioned drum 1 and primary transfer roller 2, and cleaning apparatus 10 are integrated in the form of an image formation unit Q (process cartridge Q), which is removably mountable in the main assembly A of the image forming apparatus.

The main assembly A is provided with a secondary transfer roller 11, which is positioned so that it can be placed in contact with, or separated from, the portion of the belt 6, which is in contact with the auxiliary secondary transfer roller 8. As the secondary transfer roller 11 is placed in contact with the portion of the belt 6, which is in contact with the auxiliary secondary transfer roller 8, a secondary transfer station T2 is formed between the belt 6 and secondary transfer roller 11.

The main assembly A is also provided with a belt cleaner 12, which is positioned so that it can be placed in contact with, or separated from, the portion of the belt 6, which is in contact with the tension roller 9.

When the image forming apparatus is in the full-color image formation mode, the combination of the step for forming a toner image on the drum 1 and the step for transferring (primary transfer) the toner image from the drum 1 onto the belt 6 is sequentially carried out four times, once for each of the four primary colors, that is, yellow, magenta, cyan, and black colors, in the list order. As a result, four toner images, which are different in color, are transferred in layers onto the surface of the belt 6, synthetically effecting a single unfixed full-color toner image. Incidentally, the order in which the four toner images, different in color, are to be formed does not need to be limited to the abovementioned one.

During the primary transfer, that is, while a toner image is transferred from the drum 1 onto the belt 6, the secondary transfer roller 11 and belt cleaner 12 are kept separated from the belt 6 so that the toner image (images) having just been transferred (primary transfer) onto the belt 6 is not disturbed.

In synchronism with the completion of the transfer (primary transfer) of the last color toner image onto the belt 6, that is, the completion of the synthetic formation of an unfixed full-color toner image (based on four primary colors) on the belt 6, a control is executed so that the secondary transfer roller 11 is placed in contact with the belt 6, forming thereby the secondary transfer station T2.

Meanwhile, sheets of recording medium S (which hereafter will be referred to simply as recording mediums S) are fed from the sheet feeder cassette selected from among first to fourth sheet feeder cassettes 41-44 of the sheet feeding system, into the main assembly A, while being separated one by one. Then, each recording medium S is introduced into the abovementioned secondary transfer station T2, that is, the nip between the secondary transfer roller 11 and belt 6, through a sheet conveyance path which includes a pair of registration rollers 13, with a preset control timing. Incidentally, the main assembly A is also provided with a manual feeder portion 45 (tray), through which recording mediums S can be manually fed, one by one, into the apparatus main assembly A, so that each recording medium S is introduced into the nip T2 through a sheet conveyance path which includes the pair of registration rollers 13 with the preset control timing.

Each recording medium S is conveyed through the secondary transfer station T2 while remaining pinched by the belt 6 and secondary transfer roller 11. As the recording medium S is conveyed through the secondary transfer station T2, the unfixed four monochromatic toner images, on the belt 6, which are different in color and synthetically make up the single unfixed full-color image, are transferred together (secondary transfer) onto the recording medium S. During this transfer, or the secondary transfer, a preset bias (secondary transfer bias) is applied to the secondary transfer roller 11. After being conveyed out of the secondary transfer station T2, the recording medium S is separated from the surface of the belt 6, and is introduced into a fixing device 14, which employs a heat roller. In the fixing device 14, the recording medium S and the four monochromatic toner images thereon are subjected to heat and pressure. As a result, the yellow, magenta, cyan, black toner images, which have just been transferred in layers onto the recording medium S, are fixed to the recording medium while being mixed. Consequently, a full-color print is yielded. After being conveyed out of the fixing device 14, the recording medium S is discharged by a pair of discharge roller 15 onto a delivery tray 16.

When the image forming apparatus in the black-and-white mode, only a black toner image is formed on the drum 1, and is transferred (primary transfer) onto the belt 6. Then, the black toner image is transferred (secondary transfer) from the belt 6 onto the recording medium S. Then, the recording medium S is introduced into the fixing device 14.

(2) Drum Cartridge Q and Cleaning Apparatus 10

Figure 2:
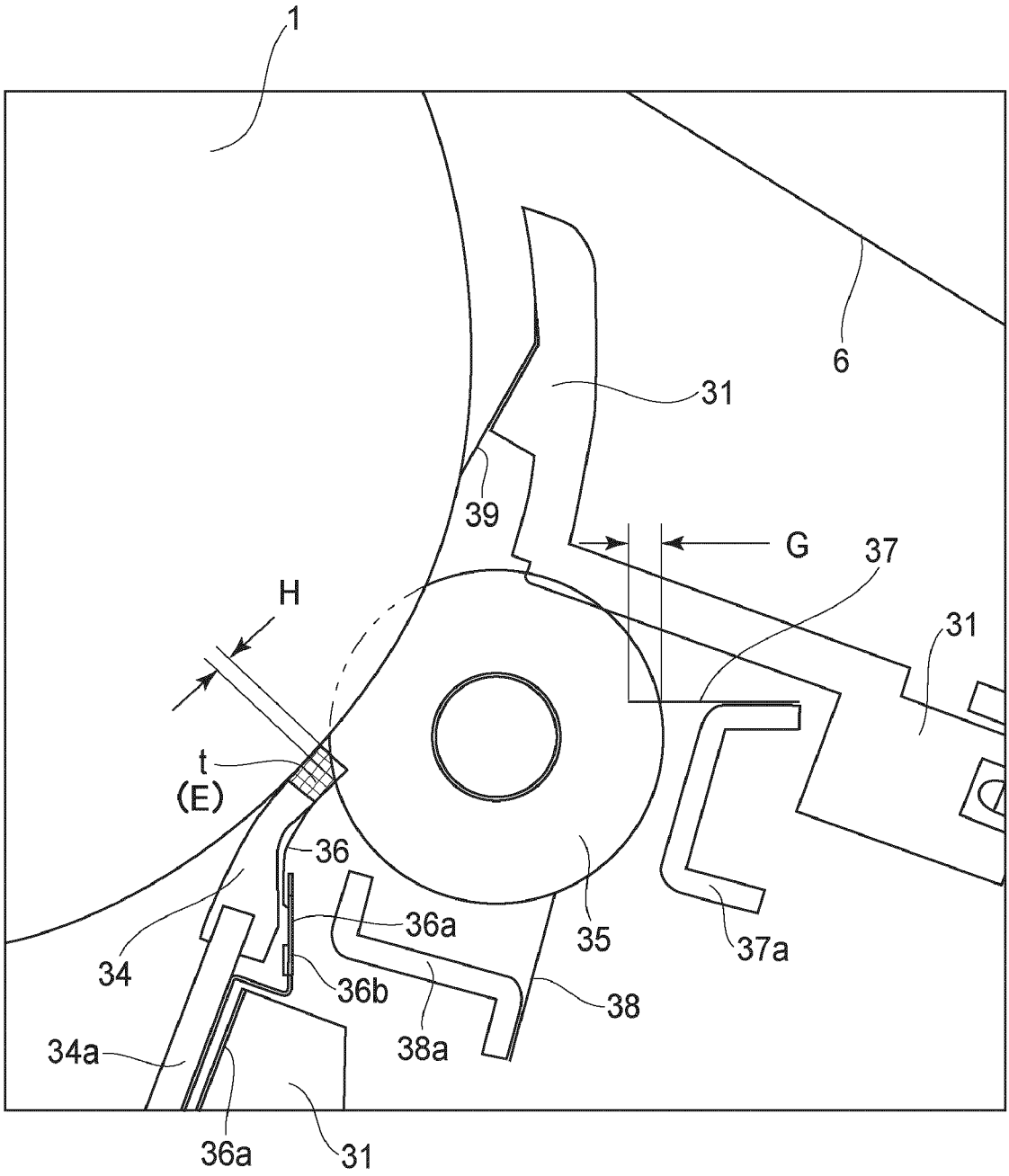
FIG. 2 is an enlarged sectional view of the cleaning apparatus portion of the image forming apparatus shown in FIG. 1.
Figure 3:
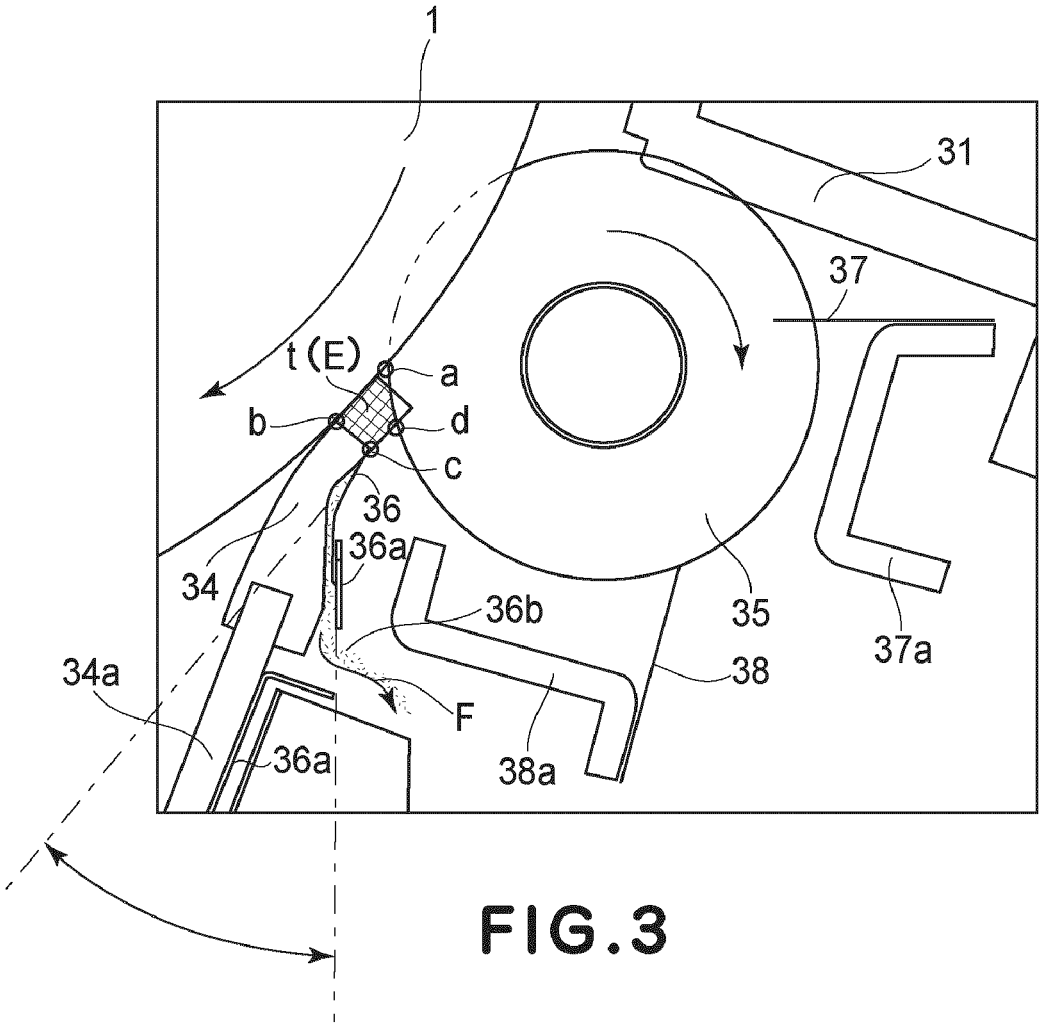
FIG. 3 is an enlarged sectional view of the cleaning apparatus portion of the image forming apparatus, in which the excessive toner is being discharged through the hole which the base plate for supporting the backup sheet has.
Figure 4:
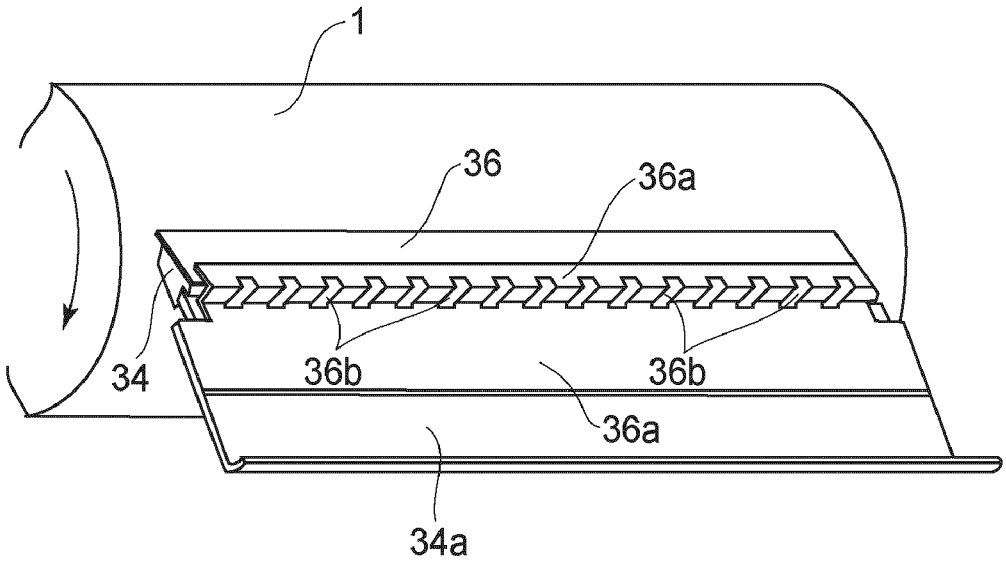
FIG. 4 is a perspective view of the drum, cleaning blade, and backup sheet.

Next, referring to FIGS. 1-4, the drum cartridge Q, which is an image formation unit, and the cleaning apparatus 10, will be described regarding their structures. FIG. 2 is an enlarged view of the cleaning apparatus portion of FIG. 1. FIG. 3 is an enlarged sectional view of the cleaning apparatus portion of the image forming apparatus, in which the excessive toner is being discharged through the hole which the base plate for supporting the backup sheet has. FIG. 4 is a perspective view of the drum, cleaning blade, and backup sheet.

The drum cartridge Q in this embodiment is an assembly made up of the drum 1, primary charge roller 2, and cleaning apparatus 10, which are integrally placed in a shell (cartridge) so that they can be removably mounted together into the apparatus main assembly A. As the cartridge Q is mounted into the apparatus main assembly A, it becomes mechanically and electrically connected to the main assembly A of the copying machine, making it possible for the image forming apparatus to carry out an image forming operation. That is, it becomes possible for the drum 1 to be rotationally driven by the driving means of the apparatus main assembly A. The primary charge roller 2 is rotated by the rotation of the drum 1. Further, it becomes possible for the electrically conductive brushing roller 35 (fur brush in the form of roller) of the cleaning apparatus 10, which is an auxiliary cleaning member, to be rotationally driven by the driving means of the apparatus main assembly A. Moreover, the electrically conductive brushing roller 35 becomes electrically connected (grounded) to the housing of the apparatus main assembly A.

The drum 1, charge roller 2, and cleaning apparatus 10 are located in the first portion 31, that is, the drum container portion, of the shell of the cartridge. The opening of the drum container portion 31 is covered with a drum cover 32, as the second portion of the cartridge shell, which is joined with the first portion 31 of the cartridge shell. In other words, the first and second portions of the cartridge shell make up waste toner storage 33.

The drum 1 is rotatably supported by the drum container portion 31 of the cartridge shell, with the interposition of bearings. Also, the charge roller 2 is rotatably supported by the drum container portion 31 with the interposition of bearings. The charge roller 2 is protected with the charger roller cover 31*a*, which is integral with the drum container portion 31.

The cleaning apparatus 10 has a cleaning blade 34 and the electrically conductive brush 35. The cleaning blade 34 is formed of rubber. The electrically conductive brush 35 is in the form of a roller, and is 18 mm in external diameter.

The cleaning blade 34 is firmly attached to the edge of a base plate 34*a* (metallic supporting plate), being thereby supported by the base plate 34*a*, and the base plate 34*a* is firmly attached to the drum container portion 31 of the cartridge shell so that the cleaning edge of the cleaning blade 34 is on the upstream side, relative to the base portion of the blade 34, in terms of the rotational direction of the drum 1.

The electrically conductive brushing roller 35 is rotatably supported by the drum container portion 31 of the cartridge shell, with the interposition of bearings. It is in contact with the drum 1, on the upstream side, relative to the area of contact between the cleaning blade 34 and drum 1, in terms of the rotational direction of the drum 1. The electrically conductive brushing roller 35 is rotationally driven in such a direction that the movement of the peripheral surface of the drum 1 in the area of contact between the drum 1 and brushing roller 35 is opposite in direction to the movement of the cleaning edges of the bristles of the brushing roller 35. Further, the electrically conductive brushing roller 35 is electrically connected (grounded) to the housing of the image forming portion A.

The cleaning apparatus 10 is provided with an elastic sheet 36 (which hereafter will be referred to as backup sheet), which is formed of urethane and is roughly 100 μm in thickness. At least a part of the backup sheet 36 is in contact with the opposite surface (back surface) of the cleaning blade 34 from the drum 1. The backup sheet 36 is firmly attached to a base plate 36*a*, as a backup sheet supporting member, being thereby supported by the base plate 36*a*. The base plate 36*a* is formed of SUS, and is roughly 0.2 mm in thickness. It is accurately positioned relative to the base plate 35*a*. The base plate 36*a* is firmly attached to the drum container portion 31 of the cartridge shell, together with the base plate 35*a* of the cleaning blade 35.

The base plate 36*a* of the backup sheet 36 is provided with a hole 36*b* for discharging excessive toner. The backup sheet 36 is disposed in contact with the electrically conductive brushing roller 35 so that its opposite edge portion from the base plate 36*a* extends beyond the cleaning edge of the cleaning blade 34 toward the electrically conductive brushing roller 35. In this embodiment, the backup sheet 36 is disposed so that the distance H by which the backup sheet 36 apparently intrudes into the electrically conductive brushing roller 35 is roughly 1 mm. This distance H is obtained by measuring in length (depth) the portion of the backup sheet 36, which is on the inward side of the tip circle of the electrically conductive brushing roller 35, when the roller 35 is stationary.

Further, the cleaning apparatus 10 is provided with a scraper 37, which is a toner removing member (brush refreshing member) for removing the toner having adhered to the brushing roller 35. The scraper 37 is placed in contact with the electrically conductive brushing roller 35. It is an elastic sheet, which is attached to a scraper attachment base member 37*a* by the portion opposite to its scraping edge, with the scraping edge portion apparently intruding by roughly 2 mm (apparent amount of intrusion G) into the electrically conductive brushing roller 35, in terms of the radius direction of the brushing roller 35. The scraper attachment base member 37*a* is firmly attached to the drum container portion 31 of the cartridge shell so that it precisely positioned. As the electrically conductive brushing roller 35 is rotated, the bristles of the brushing roller 35 are stroked and scraped by the scraper 37. Therefore, the toner having entered the spaces among the bristles of the brushing roller 35 as it is recovered by the brushing roller 35 is expelled out of the brushing roller 35. Further, the cleaning apparatus is provided with a cover sheet 38 which covers the electrically conductive brushing roller 35 to prevent the toner having been expelled from the brushing roller 35, from reentering the spaces among the bristles of the brushing roller 35. The cover sheet 38 is attached to a cover sheet attachment base 38*a*, which is firmly attached to the drum container portion 31 of the cartridge shell so that it is precisely positioned.

Moreover, the cleaning apparatus 10 is provided with an elastic sheet 39 (squeezing sheet) for preventing toner from leaking through the gap between the drum 1 and the drum container portion 31 of the cartridge shell. In terms of the rotational direction of the drum 1, the elastic sheet 39 is located upstream of the electrically conductive brushing roller 35. It is firmly attached to the drum container portion 31 of the cartridge shell by its base portion so that its functional edge portion is placed in contact with the drum 1.

Referring to FIG. 1, Line X-X and Line Y-Y are the horizontal and vertical lines (hypothetical lines) which coincide with rotational axis of the drum 1 when the drum cartridge Q is in its image forming position in the main assembly A of the copying machine. The downward direction parallel to Line Y-Y (vertical line) is the direction of gravity. In this embodiment, the primary charge roller 2 is positioned in the cartridge Q so that when the cartridge Q is in its image forming position in the apparatus main assembly A, the primary charge roller 2 is under the drum 1 (and also, in the adjacencies of Line X-X (vertical line)). The cleaning blade 34 is disposed in the cartridge Q so that when the cartridge Q is in its image forming position in the apparatus main assembly A, the point of contact between the cleaning blade 34 (cleaning edge) and drum 1 is upstream of the lowest point of the drum 1, by roughly 40°, in terms of the rotational direction of the drum 1. Next, referring to FIG. 3, the electrically conductive brushing roller 35 is disposed in the cartridge Q so that when the cartridge Q is in its image forming position in the apparatus main assembly A, the point a, that is, the point of contact between the electrically conductive brushing roller 35 and drum 1, is upstream of the point b, that is, the point of contact between the cleaning blade 34 and drum 1, by roughly 5° (FIG. 1) in terms of the rotational direction of the drum 1.

Next, referring to FIG. 3, a closed space E will be described. The closed space E is a space formed along the peripheral surface of the drum 1, between the abovementioned point b, that is, the point of contact between the cleaning blade 34 and drum 1 and the point a, that is, the point at which the electrically conductive brushing roller 35 begins to contact the peripheral surface of the drum 1. On the opposite side of the closed space E from the peripheral surface of the drum 1, the backup sheet 36 is in contact with the electrically conductive brushing roller 35. In other words, the closed space E is formed by the portion of the peripheral surface of the drum 1, which is between the abovementioned points a and b, the portion of the surface of the cleaning blade 34, which is between the point b and a point c, that is, the point of contact between the cleaning blade 34 and backup sheet 36, the portion of the backup sheet 36, which is between the point c and a point d, that is, the point at which the peripheral surface (pitch circle) of the electrically conductive brushing member 35 begins to contact the backup sheet 36, and the portion of the peripheral surface (pitch circle) of the brushing member 35, which is between the points d and a. The cleaning apparatus 10 in this embodiment is structured so that the backup sheet 36 extends beyond the cleaning edge of the cleaning blade 34 and is in contact with the electrically conductive brushing roller 35.

This closed space E is used as a toner storage. That is, before the drum cartridge Q is shipped out of a drum cartridge factory, a preset amount of toner t (FIG. 2) is stored as lubricant in this closed space E.

The above-described closed space E functions as a storage in which the preset amount of toner can be reliably stored. Therefore, by storing the preset amount of toner in this closed space, it is possible to prevent the toner from disappearing (falling) from the cleaning edge of the cleaning blade 34 due to the vibrations or the like which occur during the distribution of the cartridge Q. Therefore, this embodiment of the present invention can prevent the problem that the cleaning blade 34, as the drum cleaning member, buckles, and/or vibrates at a low frequency, right after the image forming apparatus is set up for an image forming operation, or right after the cartridge Q in the image forming apparatus main assembly is replaced with a brand-new one, or the like problems.

Further, the electrically conductive brushing roller 35 is prevented by the backup sheet 36 from contacting the toner located along the cleaning edge of the cleaning blade 34. Therefore, the toner accumulated in the closed space E during an image forming apparatus is not absorbed by the electrically conductive brushing roller 35; it is ensured that a sufficient amount of toner always remains as lubricant along the cleaning edge of the cleaning blade 34.

The residual toner, or the toner remaining on the peripheral surface of the drum 1 after the primary transfer, that is, the toner which failed to be transferred onto the belt 6 during an image forming operation, is first recovered by the rotating electrically conductive brushing member 35, which is the auxiliary drum cleaning member. Then, the toner recovered by the electrically conductive brushing roller 35 is stroked out of the electrically conductive brushing roller 35 by the scraper 37, and falls in the direction of gravity due to its own weight, and accumulates in the waste toner storage portion 33. Designated by an alphabetic reference ta is the body of toner having accumulated in the waste toner storage 33.

As the electrically conductive brushing member 35 is rotated, the portion of the electrically conductive brushing member 35, which has just been refreshed by the scraper 37, comes again into contact with the peripheral surface of the drum 1, coating thereby an appropriate amount of toner on the portion of the peripheral surface of the drum 1, which is on the upstream side of the cleaning edge of the cleaning blade 34. Then, the coated toner is scraped up by the cleaning blade 34, which is on the downstream side. As the coated toner is scraped up by the cleaning blade 34, it collects in the closed space E. In other words, the closed space E from which the toner therein is consumed during an image forming operation is replenished with toner. Therefore, it is ensured that a preset (appropriate) amount of toner is always present as lubricant along the cleaning edge of the cleaning blade 34.

Further, the cleaning blade 34 and electrically conductive brushing roller 35 are disposed so that they do not overlap in terms of the direction of gravity. Therefore, it does not occur that as the residual toner is scraped away from the cleaning blade 34, it falls onto the electrically conductive brushing roller 35. Therefore, the amount of the toner in the electrically conductive brushing roller 35 always remains constant, making it possible to control the amount by which the peripheral surface of the drum 1 is re-coated with toner by the electrically conductive brushing roller 35.

The above-described effect is obtained as long as an structural arrangement is made so that, in terms of the rotational direction of the drum 1, the point of contact between the cleaning blade 34 and drum 1, and the point of contact between the electrically conducive brushing roller 35 and drum 1, are no more than 90° away from the lowest point of the drum 1 in terms of the direction of gravity, and also, so that the point of contact between the cleaning blade 34 and drum 1 does not overlap with the sweeping area of the electrically conductive brushing roller 35 in terms of the direction of gravity.

The refreshing effect of the means for refreshing the electrically conductive roller 35 can be enhanced by using a sheet of elastic substance as the material for the scraper 37. The recovered toner, that is, the toner having entered the spaces among the bristles of the electrically conductive brushing roller 35, can be aggressively moved out of the brushing roller 35 by disposing the scraper 37 formed of a sheet of elastic substance, so that the scraping edge portion of the scraper 37 apparently intrudes into the electrically conductive brushing roller 35 by roughly 2 mm in terms of the radius direction of the roller 35. Further, the electrically conductive brushing roller 35 is covered by the cover sheet 38 to prevent the toner, which has just been expelled from the brushing roller 35 after being recovered by the brushing roller 35, from reentering the spaces among the bristles of the brushing roller 35. After being expelled from the electrically conductive brushing roller 35, the toner falls down due to its own weight, and accumulates in the waste toner storage portion 33.

Not only does the electrically conductive brushing roller 35, which is grounded to the housing portion of the main assembly A of the copying machine, remove the electrical charge from the transfer residual toner, which is the same in potential level as the peripheral surface of the drum 1, but also, disturbs the residual toner, assisting thereby the cleaning blade 34 in cleaning the drum 1.

In this embodiment, the distance (depth) G of the apparent intrusion of the scraper 37 into the electrically conductive brushing roller 35 is roughly 2 mm, and the distance (depth) H of the apparent intrusion of the free edge portion of the backup sheet 36 into the electrically conductive brushing roller 35 is greater than roughly 1 mm. Therefore, the toner having accumulated in the electrically conductive brushing roller 35 does not directly come into contact with the free edge portion of the backup sheet 36. Therefore, the damage to the free edge portion of the backup sheet 36 is minimized, ensuring that a preset (appropriate) amount of toner always remains along the cleaning edge of the cleaning blade 34.

If an excessive amount of toner happens to enter the above-described closed space E, the excessive toner applies pressure to the backup sheet 36, causing thereby the backup sheet 36 to separate from the cleaning blade 34. Therefore, the excessive toner moves out of the closed space E through the gap between the cleaning blade 34 and the backup sheet 36, and then, is discharged in the direction indicated by an arrow mark F in FIG. 3, through the excessive toner discharge hole 36*b*, with which the base plate 36*a* is provided. Therefore, the amount by which toner remains along the cleaning edge of the cleaning blade 34 remains stable at the preset (appropriate) level.

Also in this embodiment, not only is the gap provided between the cleaning blade 34 and backup sheet 36 made wedge by slanting the backup sheet supporting surface of the base plate 36*a*, relative to the portion of the back surface of the cleaning blade 34, which the backup sheet 36 contacts, but also, the backup sheet supporting base plate 36*a* is provided with the excess toner discharge hole 36*b*. Therefore, if an excessive amount of toner happens to enter the above described closed space E, the toner overflow (excessive toner) travels along the slanted surface of the base plate 36*a*, and then, is expelled through the hole 36*b*. Therefore, the preset (appropriate) amount of toner always remains as lubricant along the cleaning edge of the cleaning blade 34.

In this embodiment, the backup sheet 36 is independent from the cleaning blade 34. However, the backup sheet 36 may be integrated with the cleaning blade 34 by directly bonding the backup sheet 36 to the cleaning blade 34. However, if the backup sheet 36 is directly bonded to the cleaning blade 34, it is impossible for the excessive toner to be discharged as it is in this embodiment. Therefore, the structural arrangement in this embodiment is preferable.

The auxiliary cleaning member 35 does not need to be the electrically conductive brushing roller. That is, it may be an electrically conductive elastic rubber roller. Further, the auxiliary cleaning member 35 may be rotated in such a direction that the peripheral surface (tip circle) of the auxiliary cleaning member 35 and the peripheral surface of the drum 1 move in the same direction, in the interface between the auxiliary cleaning member 35 and drum 1.

The image bearing member 1 may be in the form of a circularly movable belt. Further, the image bearing member 1 does not need to be an electrophotographic photosensitive member. That is, it may be an electrostatically recordable dielectric member, an intermediary transfer member, or the like.

The image forming apparatus may be structured so that a toner image formed on the image bearing member 1 is directly transferred onto the recording medium S.

As described above, the present invention can stabilize the amount by which toner is retained along the line of contact between the cleaning blade and drum, regardless of the type of the image formed on the drum.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 308894/2006 filed Nov. 15, 2006, which is hereby incorporated by reference.

What is claimed is:

1. A cleaning device comprising:

a cleaning blade for contacting to a rotatable image bearing member and removing toner from the image bearing member;

a rotatable brush, disposed upstream of said cleaning blade with respect to a rotational direction of said image bearing member, for assisting a cleaning operation of said cleaning blade;

a sheet contacted to said brush and to a surface of said cleaning blade which is remote from said image bearing member; and a removing member for entering into said brush and removing the toner deposited on said brush, wherein an entering amount of said removing member into said brush is larger than an entering amount of said sheet into said brush.

2. A cleaning device according to claim 1, wherein a rotational direction of said rotatable brush is opposite to the rotational direction of said image bearing member.

3. A cleaning device according to claim 1, wherein a contact portion between said cleaning blade and said image bearing member is below a contact portion between said brush and said image bearing member.

4. A cleaning device according to claim 1, wherein said sheet moves away from said cleaning blade by a pressure of the toner accumulated between said image bearing member and said sheet, and the toner falls through a gap provided between said cleaning blade and said sheet by the pressure.

5. A cleaning device according to claim 1, further comprising a supporting member for supporting said sheet, wherein said supporting member is provided with a hole portion through which the toner falls into a toner accommodating portion.

6. An image forming apparatus comprising:

a rotatable image bearing member;

a cleaning blade for contacting to said rotatable image bearing member and removing toner from said image bearing member;

a rotatable brush, disposed upstream of said cleaning blade with respect to a rotational direction of said image bearing member, for assisting a cleaning operation of said cleaning blade;

a sheet contacted to said brush and to a surface of said cleaning blade which is remote from said image bearing member; and a removing member for entering into said brush and removing the toner deposited on said brush, wherein an entering amount of said removing member into said brush is larger than an entering amount of said sheet into said brush.

* * * * *